US006790104B2

(12) United States Patent
Antaya et al.

(10) Patent No.: US 6,790,104 B2
(45) Date of Patent: Sep. 14, 2004

(54) ELECTRICAL TERMINAL

(75) Inventors: Stephen Antaya, West Kingston, RI (US); Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 10/207,656

(22) Filed: Jul. 26, 2002

(65) Prior Publication Data

US 2004/0018782 A1 Jan. 29, 2004

(51) Int. Cl.[7] ..... H01R 4/48
(52) U.S. Cl. ..... 439/862; 439/876; 439/83
(58) Field of Search ..... 439/862, 884, 439/83, 78, 71, 866, 874, 876, 948, 846, 81

(56) References Cited

U.S. PATENT DOCUMENTS

| | | | | |
|---|---|---|---|---|
| 2,709,211 A | * | 5/1955 | Glynn | 439/83 |
| 3,560,630 A | * | 2/1971 | Heather | 439/883 |
| 3,634,654 A | | 1/1972 | Peetz et al. | 219/522 |
| 3,858,378 A | | 1/1975 | Allen et al. | 52/759 |
| 3,918,783 A | | 11/1975 | DuRocher et al. | 339/17 |
| 3,981,556 A | | 9/1976 | Sabatelli et al. | 339/275 |
| 4,023,008 A | | 5/1977 | Durussel | 219/522 |
| 4,246,467 A | | 1/1981 | Boaz | 219/522 |
| 4,425,021 A | | 1/1984 | Nicolino | 339/275 |
| 4,491,844 A | | 1/1985 | Tsuchie et al. | 343/713 |
| 5,082,452 A | | 1/1992 | Takano | 439/206 |
| 5,268,700 A | | 12/1993 | Hirotsu et al. | 343/713 |
| 5,543,601 A | | 8/1996 | Bartrug et al. | 219/203 |
| 5,676,562 A | | 10/1997 | Fukuda | 439/329 |
| 5,928,455 A | * | 7/1999 | Dizin et al. | 439/83 |
| 6,249,966 B1 | | 6/2001 | Pereira et al. | 29/882 |
| 6,267,630 B1 | | 7/2001 | Machado | 349/876 |
| 6,336,737 B1 | | 1/2002 | Thau | 362/494 |

FOREIGN PATENT DOCUMENTS

| | | |
|---|---|---|
| GB | 1 449 479 | 9/1976 |
| JP | 11 242978 A | 9/1999 |

* cited by examiner

*Primary Examiner*—P. Austin Bradley
*Assistant Examiner*—Felix O. Figueroa
(74) *Attorney, Agent, or Firm*—Hamilton, Brook, Smith & Reynolds, P.C.

(57) ABSTRACT

An electrical terminal includes a generally planar base pad having two opposed legs and an intermediate portion. The base pad legs have proximal and distal ends and are joined at the proximal ends to the intermediate portion. The legs are spaced apart from each other to form a gap between the legs. The base pad legs have inner edges facing each other which extend away from each other moving away from the proximal ends of the base pad legs to the distal ends. A connector arm having a neck extends upwardly from the intermediate portion of the base pad between the base pad legs and terminates in a blade connector for engaging with a mating terminal. The neck has a proximal end with a width that is less than the gap between the proximal ends of the base pad legs by about ½ mm to 3 mm. The neck has a narrowing section moving away from the proximal end of the neck.

23 Claims, 3 Drawing Sheets

ELECTRICAL TERMINAL

BACKGROUND

In automotive applications, sometimes electrical terminals are soldered to a surface, for example, a windshield, by an automated soldering machine. Typically, the electrical terminals are supplied to the automated soldering machine by a vibratory feeder. The vibratory feeder has a bowl into which a large supply of the electrical terminals are dumped. The vibratory feeder then moves the electrical terminals from the bowl to the automated soldering machine by vibration.

In some applications, for example on windshields, small electrical terminals are desirable in order to provide maximum visibility as well as to provide a more pleasing appearance. However, some small electrical terminals, for example, those having a design with a base pad about 10 mm by 14 mm in size or smaller, and a blade connector extending therefrom, tend to lock together when dumped into the bowl of the vibratory feeder. Some of these electrical terminals can become so tenaciously locked together that even the vibrations from the vibratory feeder cannot separate the electrical terminals from each other. Such locking together of electrical terminals can cause jamming of the automated soldering machine when electrical terminals that are locked together are fed into the machine.

SUMMARY

The present invention provides an electrical terminal which generally does not lock together with other electrical terminals in an inseparable manner, and therefore is suitable for feeding into an automated soldering machine by a vibratory feeder. The electrical terminal includes a generally planar base pad having two opposed legs and an intermediate portion. The base pad legs have proximal and distal ends and are joined at the proximal ends to the intermediate portion. The base pad legs are spaced apart from each other to form a gap between the legs. The base pad legs have inner edges facing each other which extend away from each other moving away from the proximal ends of the base pad legs to the distal ends. A connector arm having a neck extends upwardly from the intermediate portion of the base pad between the base pad legs and terminates in a blade connector for engaging with a mating terminal. The neck has a proximal end with a width that is less than the gap between the proximal ends of the base pad legs by about ½ mm to 3 mm. The neck has a narrowing section moving away from the proximal end of the neck.

In preferred embodiments, the electrical terminal is formed of sheet metal. The inner edges of the base pad legs are angled outwardly about 4° relative to each other. The neck has side edges which are angled inwardly towards each other. Each side edge of the neck is angled about 5° from the inner edge of an adjacent base pad leg. The side edges of the neck, after angling towards each other, extend outwardly to form a pair of protrusions between the neck and the blade connector. Preferably, the proximal end of the neck has a width that is less than the gap between the proximal ends of the base pad legs by about 1 to 1¾ mm. The base pad legs and the intermediate portion have outer edges which are at right angles to each other. The base pad has an outer perimeter that is no greater than about 10 mm by 14 mm and is often 10 mm by 13 mm. The connector arm is bent upwardly from the intermediate portion of the base pad and then bent laterally away from the intermediate portion. The base pad has a bottom surface with at least one standoff. A layer of solder can be applied on the bottom surface of the base pad.

The present invention provides a design that is suitable for use with small electrical terminals having a base pad 10 mm by 14 mm and smaller which does not inseparably lock together with other terminals, and at the same time, when soldered to a surface, has a solder joint with a pull strength within desirable ranges.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF EMBODIMENTS OF THE INVENTION

Figure 1:
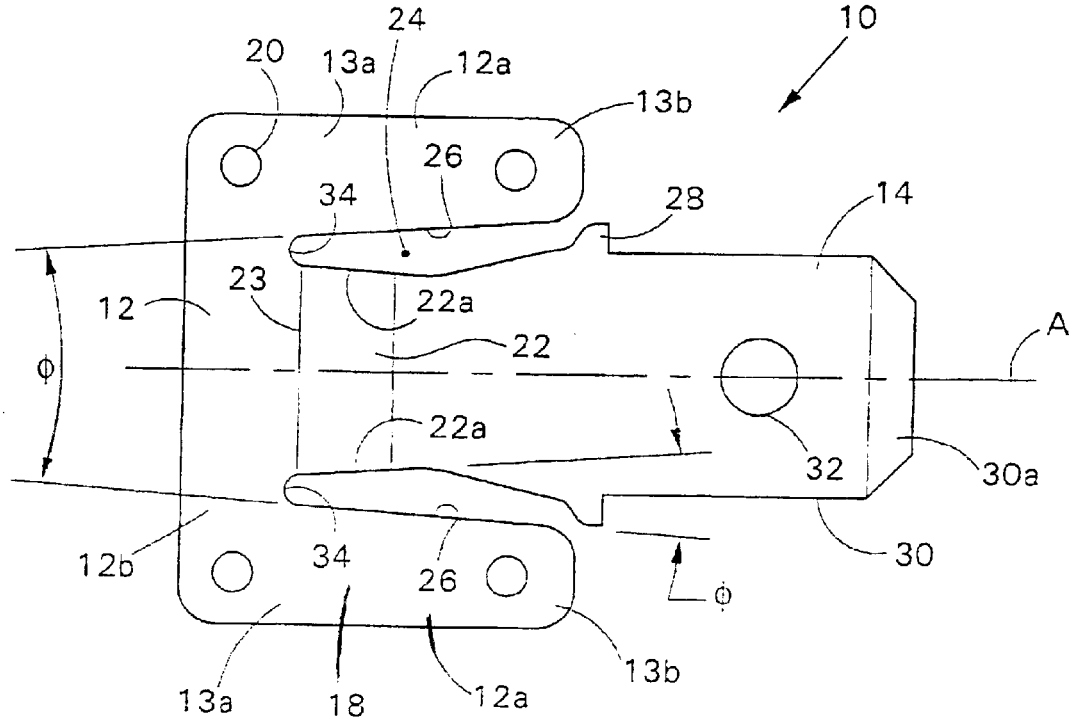
FIG. 1 is a bottom view of an embodiment of the present invention electrical terminal.
Figure 2:
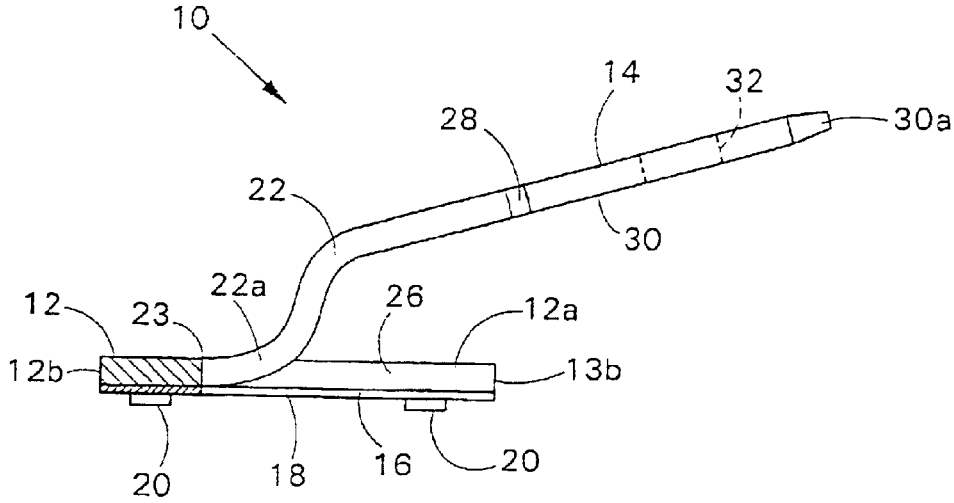
FIG. 2 is a side view of the electrical terminal of FIG. 1 with a base pad leg removed for clarity.

Referring to FIGS. 1 and 2, electrical terminal 10 is an embodiment of an electrical terminal in the present invention that can be fed into an automated soldering machine by a vibratory feeder without the electrical terminal 10 locking together with other adjacent electrical terminals 10 in an inseparable manner. Vibrations from the vibratory feeder are generally sufficient to separate most electrical terminals 10 from each other.

Electrical terminal 10 is formed from sheet metal and includes a planar base pad 12 having two legs 12*a* with proximal 13*a* and distal 13*b* ends that are joined at the proximal ends 13*a* to opposite ends of an intermediate portion 12*b* with the outer edges of base pad legs 12*a* being at right angles to the outer edge of intermediate portion 12*b*. The base pad legs 12 are separated from each other by a gap 24. The base pad legs 12*a* have inner side edges 26 on opposite sides of the gap 24 which are angled away from each other moving from the proximal ends 13*a* of legs 12*a* towards the distal ends 13*b*.

A connector arm 14 extends upwardly from the intermediate portion 12*b* of base pad 12 from a location starting between the proximal ends 13*a* of the base pad legs 12*a*. The connector arm 14 has a neck 22 extending from the intermediate portion 12*b* and a blade connector 30 extending from the neck 22 for engaging with a mating electrical connector. Opposed stop protrusions or tabs 28 are positioned between the neck 22 and the blade connector 30 to prevent advancement of the mating electrical connector past the blade connector 30. Both the blade connector 30 and the base 23 of the neck 22 of connector arm 14 are narrower than the gap 24 at the location between the proximal ends 13*a* of the base pad legs 12*a* by a minimal amount of space. The neck 22 angles inwardly before widening to form stop tabs 28.

A series of standoffs 20 extend from the bottom surface of the base pad 12. A layer of solder 18 covers the bottom surface 16 which in turn can be coated with flux. When heated during soldering, the layer of solder 18 reflows to solder the electrical terminal 10 to the desired surface, often automotive glass, with the standoffs 20 ensuring that at least a predetermined volume of solder 18 is maintained between the bottom surface 16 of the base pad 12 and the surface.

Electrical terminal 10 has a design that allows electrical terminals 10 engaged with each other to separate relatively easily. The combination of the widening gap 24 between the base pad legs 12*a* and the narrowing neck 22 provides sufficient clearance between the base pad legs 12*a* and the neck 22 of connector arm 14 so that other electrical terminals 10 do not become inseparably wedged or jammed therebetween. In addition, the outwardly angled configuration of the inner side edges 26 of base pad legs 12*a* is a design that allows other electrical terminals 10 engaged between the base pad legs 12*a* to slide easily off rather than remain entangled. One feature that makes this possible is that the inner side edges 26 are provided with smooth surfaces to promote sliding. Another feature is that the outwardly angled side edges 26 extend outwardly along the full length of the base pad legs 12*a* and are not able to retain other electrical terminals 10 therebetween as firmly as when side edges are parallel to each other, because the outwardly angled surfaces of side edges 26 allow more degrees of movement of objects therebetween than if the side edges 26 were to be parallel to each other. The outer edges of base pad 12 are smooth with rounded corners to further promote sliding of the electrical terminals 10 relative to each other instead of entanglement.

Figure 3:
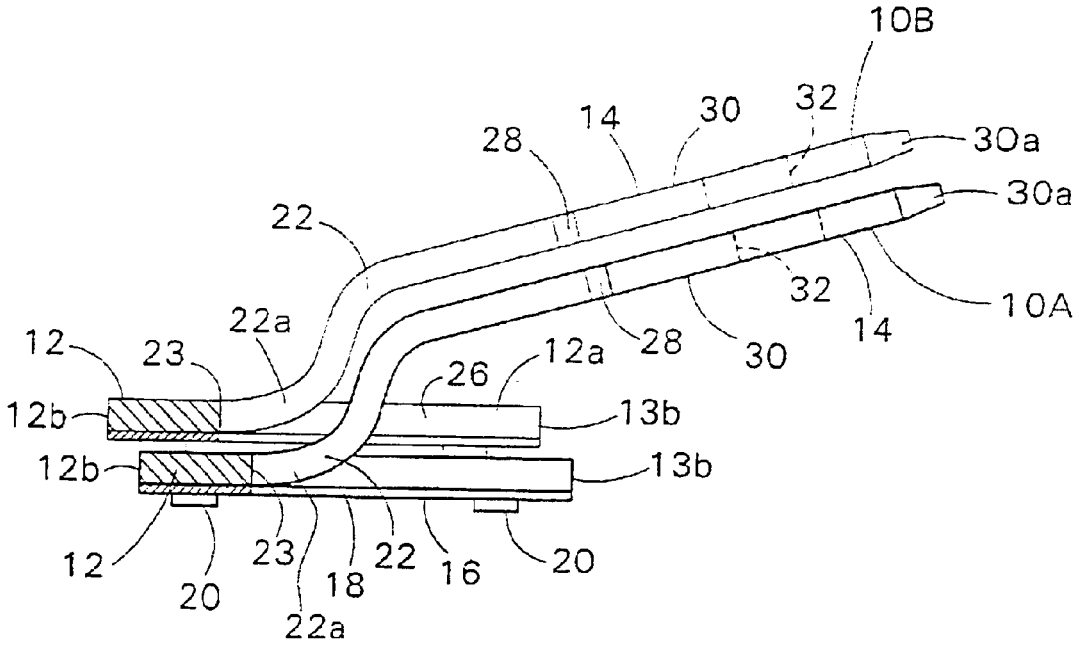
FIG. 3 is a side view of two electrical terminals nested together, each with a base pad leg removed for clarity.

The gap 24 between the base pad legs 12*a* is sized to be minimally larger than both the neck 22 and blade connector 30 of connector arm 14, so that in combination with the outwardly angled inner side edges 26, the neck 22 and blade connector 30 of other electrical terminals 10 cannot become wedged or jammed between the base pad legs 12*a*. Providing the neck 22 with side edges 22*a* which angle towards each other, forms a narrowing section which increases clearances between the neck 22 and the base pad legs 12*a*. Consequently, referring to FIG. 3, a first electrical terminal 10A can have a second electrical terminal 10B nested thereon without the neck 22 of the second electrical terminal 10B becoming wedged or jammed between the base pad legs 12*a* of the first electrical terminal 10A. Such nesting can cause prior art electrical terminals to jam together.

Extending the neck 22 of connector arm 14 upwardly from the base pad 12 before extending the connector arm 14 outwardly provides enough clearance between the connector arm 14 and the base pad legs 12*a* (FIG. 2) to prevent other electrical terminals 10 from wedging or jamming therebetween. In addition, the connector arm 14 is bent with smooth radiuses to provide surfaces that promote sliding of other electrical terminals 10 therefrom rather than catching or capturing of the other electrical terminals. Although the stop tabs 28 can extend wider than the gap 24 between base pad legs 12*a*, the stop tabs 28 are positioned on the connector arm 14 far enough away from the base pad 12 so that the ability of stop tabs 28 to entangle with portions of other electrical terminals 10 is minimized.

The design of electrical terminal 10 is suited for small electrical connectors where the difference in width between the base pad 12 and connector arm 14 is not very large. In some embodiments of FIG. 1, the width of base pad 12 is only about 2 times larger than the width of blade connector 30. As a result, with such a small footprint of base pad 12 in relation to the width of connector arm 14, it is desirable to maximize the size or surface area of the base pad 12 to obtain a strong solder joint while at the same time have a design that does not cause inseparable locking between electrical terminals 10. This becomes difficult when the footprint of the base pad 12 is about 10 mm by 14 mm and smaller because the connector arm 14 is bent upwardly from the intermediate portion 12*b* hear the center of base pad 12 thereby drastically reducing the solderable surface area of base pad 12.

In order to compensate for the reduced solderable surface area, the gap 24 at the location between the proximal ends 13*a* of the base pad legs 12*a* is only minimally larger than the base 23 of neck 22 of connector arm 14. The fact that the connector arm 14 extends from base pad 12 close to the central region of base pad 12 directs any forces exerted on connector 14 by mating electrical connectors to the central region of base pad 12. More force is required to separate a soldered joint if directed at the center of the base pad 12 than if directed at a side edge. Side edge directed forces cause a pealing action which requires less force to separate a soldered joint than a centrally directed force. In addition, by providing base pad 12 with standoffs 20, each electrical terminal 10, when soldered, is spaced apart from the surface to which the electrical terminal 10 is being soldered by at least the height of the standoffs 20 so that the solder joint includes at least a suitable predetermined amount of solder 18 between the base pad 12 and the surface. This ensures that the solder joint can have a certain predetermined amount of strength.

In one embodiment of electrical terminal 10 as shown in FIGS. 1 and 2, base pad 12 has a footprint that is about 10 mm by 13 mm. The intermediate portion 12*b* of base pad 12 is about 2.7 mm wide. The outer corners of base pad 12 are rounded with a 0.8 mm radius which further aids in the ability of the electrical terminal 10 to separate from other electrical terminals 10. The base pad legs 12*a* are about 3 mm wide at the proximal end 13*a*. The inner edges 26 of base pad legs 12*a* face each other and are at an angle θ relative to each other moving from the proximal ends 13*a* to the distal ends 13*b* of the base pad legs 12*a*. Typically, the angle θ ranges from about 2° and 6°, with 4° being common. When θ is about 4°, each inner side edge 26 is angled relative to the central axis A of electrical connector 10 about 2°. The standoffs 20 have a diameter of about 1 mm and are about 0.2 mm high. Although four standoffs 20 are shown, more than four or fewer than four standoffs 20 can be employed. The solder 18 is typically 27% Sn, 70% Pb and 3% Ag and is 0.35 mm thick, but other suitable solder compositions can be employed. including lead free solders. The layer of solder 18 can be omitted from electrical connector 10, and in such a case, a supply of solder must be introduced later during the soldering process.

The connector arm 14 is bent upwardly from the intermediate portion 12*b* of base pad 12 at about a 1.9 mm radius to a height of about 5 mm and is then bent outwardly at about a 1.9 mm radius to form an outwardly and upwardly 15° angled portion that extends about 14.2 mm. Neck 22 of connector arm 14 has side edges 22 a which are separated at the base 23 of neck 22 from the side edges 26 of base pad legs 12*a* by notches 34 in base pad 12. The notches 34 are sized to provide the neck 22 with a base 23 that is about ½ mm to 3 mm narrower than the gap 24 between the proximal ends 13*a* of base pad legs 12*a*, with about 1 mm to 1 ¾ mm being more typical. Making the neck 22 narrower than the gap 24 by such an amount provides enough clearance to prevent inseparable locking of electrical terminals 10 together while at the same time maximizing the solderable surface area of base pad 12. In one embodiment, the notches 34 have a radius of about 0.38 mm resulting in a neck base 23 that is about 1.52 mm less than gap 24 at the proximal ends 13*a* of base pad legs 12*a*. The side edges 22*a* of neck 22 angle inwardly towards each other starting from the base 23. The side edges 22*a* of neck 22 extend at an angle $\phi$ between the side edge 22*a* and the side edge 26 of the adjacent base pad leg 12*a*. The angle $\phi$ is typically between 3° and 7°, with 5° being common. The blade connector 30 is about 6.3 mm wide and 8.5 mm long. The tip 30*a* of blade connector tapers to a width of about 4.5 mm and is angled on the top and bottom surfaces at about 10°. The blade connector 30 includes a locking hole 32 for engaging a protrusion of a mating electrical connector. Locking hole 32 is positioned about 4.2 mm away from the tip 30*a* and has a diameter about 2 mm. The side edges 22*a* of neck 22, after angling inwardly towards each other, angle outwardly to form stop tabs 28. The distance between the outer edges of the two stop tabs 28 is about 7.8 mm.

Electrical terminal 10 is typically formed of sheet metal such as tempered 110/102 copper about 0.78 mm thick and plated 0.2 to 0.4 mil thick for power applications such as window defrosters. For non-power applications, such as for antennas, electrical terminal 10 can be formed of sheet metal about 0.38 mm thick.

Figure 4:
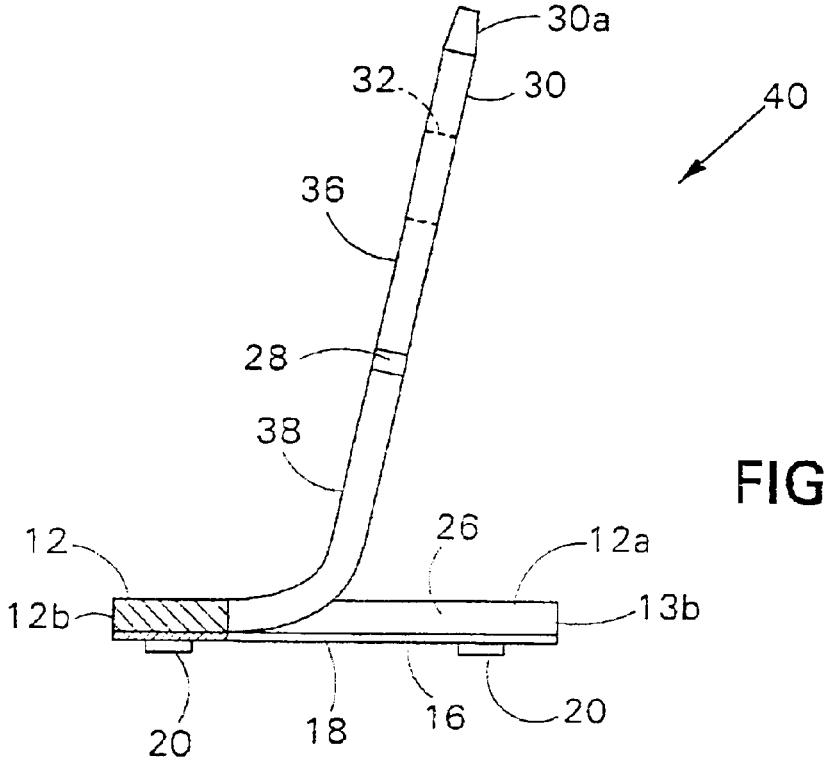
FIG. 4 is another embodiment of an electrical terminal of the present invention with a base pad leg removed for clarity.

Referring to FIG. 4, electrical terminal 40 is another embodiment of an electrical terminal in the present invention which differs from electrical terminal 10 in that connector arm 36 has a neck 38 which is only bent upwardly and does not include a second radius bend.

Figure 5:
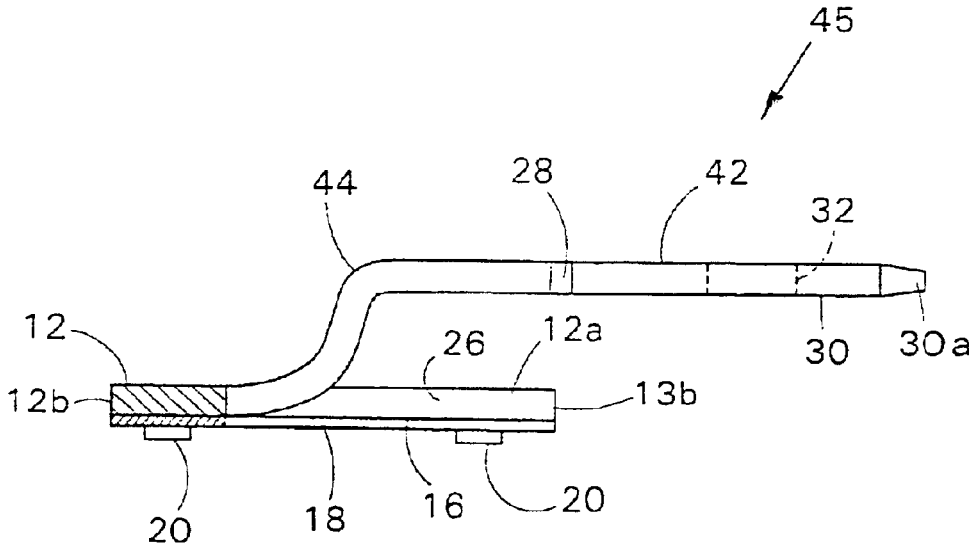
FIG. 5 is yet another embodiment of an electrical terminal of the present invention with a base pad leg removed for clarity.

Referring to FIG. 5, electrical terminal 45 is yet another embodiment of an electrical terminal in the present invention which differs from electrical terminal 10 in that connector arm 42 has a neck 44 which is bent horizontally or parallel to base pad 12. As is apparent, the electrical terminals in the present invention can include connector arms which can be bent in many different configurations depending upon the situation at hand. In some applications, the connector arms can be bent to extend in the direction pointing away from the distal ends 13*b* of base pad legs 12*a*.

Although the electrical terminals in the present invention have been shown in the figures to have edges with straight or angled contours, alternatively, side edges 26 and 22*a* as well as the outer perimeter of base pad 12 can include curved surfaces. In addition, the electrical terminals can be made of other suitable types of sheet metal instead of copper, such as steel, aluminum, etc., and can be of other suitable thicknesses than those described above. In some embodiments, the electrical terminals can be formed by molding. Although the design of the electrical terminals is suitable for small base pad 12 sizes 10 mm by 14 mm and less, electrical terminals with base pads 12 larger than 10 mm by 14 mm are also envisioned. Furthermore, connector arm 14 can terminate in any other suitable male or female connector configurations such as pin connectors, snap sockets, etc.

While this invention has been particularly shown and described with references to preferred embodiments thereof, it will be understood by those skilled in the art that various changes in form and details may be made therein without departing from the scope of the invention encompassed by the appended claims. For example, features of the different embodiments of the electrical terminals in the present invention can be combined or omitted. In addition, although specific dimensions have been provided, it is understood that dimensions can vary to suit the application at hand. Furthermore, although the electrical terminal in the present invention is typically soldered to automotive glass, it is understood that the electrical terminal can be soldered to any suitable surface or substrate.

What is claimed is:

1. An electrical terminal comprising:

a generally planar base pad having two opposed legs and an intermediate portion, the legs having proximal and distal ends, the legs being joined at the proximal ends to the intermediate portion and spaced apart from each other to form a gap between the legs, the base pad legs having inner edges facing each other, the inner edges continuously angling away from each other moving away and along from the proximal ends of the base pad legs to the distal ends; and a connector arm having a neck extending upwardly from the intermediate portion of the base pad between the base pad legs and terminating in a blade connector for engaging with a mating terminal, the neck having a proximal end with a width that is less than the gap between the proximal ends of the base pad legs by about ½ mm to 3 mm. the neck having a narrowing section moving away from the proximal end of the neck.

2. The terminal of claim 1 in which the base pad has a bottom surface with at least one standoff.

3. The terminal of claim 2 further comprising a layer of solder on the bottom surface of the base pad.

4. The terminal of claim 1 in which the terminal is formed of sheet metal.

5. The terminal of claim 4 in which the proximal end of the neck has a width that is less than the gap between the proximal ends of the base pad legs by about 1 mm to 1 ¾ mm.

6. The terminal of claim 4 in which the inner edges of the base pad legs are angled outwardly about 4° relative to each other.

7. The terminal of claim 6 in which the neck has side edges which are angled inwardly towards each other.

8. The terminal of claim 7 in which each side edge of the neck is angled about 5° from the inner edge of an adjacent base pad leg.

9. The terminal of claim 8 in which the side edges of the neck after angling towards each other extend outwardly to form a pair of protrusions between the neck and the blade connector.

10. The terminal of claim 8 in which the base pad legs and intermediate portion have outer edges which are at right angles to each other.

11. The terminal of claim 10 in which the base pad has an outer perimeter that is no greater than about 10 mm by 14 mm.

12. The terminal of claim 11 in which the outer perimeter is about 10 mm by 13 mm.

13. The terminal of claim 12 in which the connector arm is bent upwardly from the intermediate portion of the base pad and then bent laterally away from the intermediate portion.

14. An electrical terminal formed of sheet metal comprising:

a generally planar base pad having two opposed legs and an intermediate portion, the legs having proximal and distal ends, the legs being joined at the proximal ends to the intermediate portion and spaced apart from each other to form a gap between the legs, the base pad legs having inner edges facing each other, the inner edges continuously angling away from each other moving away and along from the proximal ends of the base pad legs to the distal ends, the base pad legs and intermediate portion having outer edges which are at right angles to each other, the base pad having an outer perimeter than is no greater than about 10 mm by 14 mm; and a connector arm having a neck extending upwardly from the intermediate portion of the base pad between the base pad legs and terminating in a blade connector for engaging with a mating terminal, the neck having a proximal end with a width that is less than the gap between the proximal ends of the base pad legs by about 1 mm to 1 ¾ mm, the neck having a narrowing section moving away from the proximal end of the neck and having side edges which are angled inwardly towards each other before extending outwardly to form a pair of protrusions between the neck and the blade connector.

15. The terminal of claim 14 in which the inner edges of the base pad legs are angled outwardly about 4° relative to each other.

16. The terminal of claim 15 in which each side edge of the neck is angled about 5° from the inner edge of an adjacent base pad leg.

17. The terminal of claim 16 in which the outer perimeter is about 10mm by 13 mm.

18. The terminal of claim 17 in which the connector arm is bent upwardly from the intermediate portion of the base pad and then bent laterally away from the intermediate portion.

19. The terminal of claim 14 in which the base pad has a bottom surface with at least one standoff.

20. The terminal of claim 19 further comprising a layer of solder on the bottom surface of the base pad.

21. An electrical terminal formed of sheet metal comprising:

a generally planar base pad having two opposed legs and an intermediate portion, the legs having proximal and distal ends, the legs being joined at the proximal ends to the intermediate portion and spaced apart from each other to form a gap between the legs, the base pad legs having inner edges facing each other, the inner edges continuously angling away from each other moving away and along from the proximal ends of the base pad legs to the distal ends; and a connector arm having a neck extending upwardly from the intermediate portion of the base pad between the base pad legs and terminating in an electrical connector for engaging with a mating terminal, the neck having a proximal end with a width that is less than the gap between the proximal ends of the base pad legs by about ½ mm to 3 mm, the neck having a narrowing section moving away from the proximal end of the neck.

22. An electrical terminal comprising:

a generally planar base pad having two opposed legs and an intermediate portion, the legs having proximal and distal ends, the legs being joined at the proximal ends to the intermediate portion and spaced apart from each other to form a gap between the legs, the base pad legs having inner edges facing each other, the inner edges continuously angling away from each other moving away and along from the proximal ends of the base pad legs to the distal ends; and a connector arm having a neck extending upwardly from the intermediate portion of the base pad between the base pad legs and terminating in a blade connector for engaging with a mating terminal, the neck having a proximal end with a width that is less than the gap between the proximal ends of the base pad legs, the neck having a narrowing section moving away from the proximal end of the neck.

23. An electrical terminal formed of sheet metal comprising:

a generally planar base pad having two opposed legs and an intermediate portion, the legs having proximal and distal ends, the legs being joined at the proximal ends to the intermediate portion and spaced apart from each other to form a gap between the legs, the base pad legs having inner edges facing each other, the inner edges contiuously angling away from each other moving away and along from the proximal ends of the base pad legs to the distal ends; and a connector arm having a neck extending upwardly from the intermediate portion of the base pad between the base pad legs and terminating in an electrical connector for engaging with a mating terminal, the neck having a proximal end with a width that is less than the gap between the proximal ends of the base pad legs.

* * * * *